US008348256B1

(12) United States Patent
Aw et al.

(10) Patent No.: US 8,348,256 B1
(45) Date of Patent: Jan. 8, 2013

(54) CHANGE-OVER BETWEEN GEAR TRAINS IN A PRINTER

(75) Inventors: Kok-Wah Aw, Singapore (SG); Pay-Kuan Lim, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/232,744

(22) Filed: Sep. 14, 2011

(51) Int. Cl.
*B65H 5/00* (2006.01)

(52) U.S. Cl. ..... 271/10.04; 271/10.03

(58) Field of Classification Search .... 271/10.01–10.04, 271/264, 265.01, 4.04, 9.01, 9.13, 9.03
See application file for complete search history.

(56) References Cited

U.S. PATENT DOCUMENTS 5,443,437 A 8/1995 Mack
5,704,606 A 1/1998 Kim
6,641,130 B2 * 11/2003 Lee et al. ..... 271/10.04
6,811,151 B2 * 11/2004 Wei-Feng et al. ..... 271/10.03
6,969,063 B2 11/2005 Park
7,597,321 B2 * 10/2009 Sawai ..... 271/264
8,123,210 B1 * 2/2012 Murray ..... 271/4.04
8,167,295 B2 * 5/2012 Hashimoto ..... 271/9.02
2009/0059313 A1 3/2009 Tseng et al.
2011/0101600 A1 * 5/2011 Chihara et al. ..... 271/152

* cited by examiner

*Primary Examiner* — Patrick Cicchino

(57) ABSTRACT

A printer includes multiple gear trains, each gear train to pick paper. The printer also includes a print media sensor to detect the presence of print media along a paper path, a user input control, and control logic coupled to the print media sensor and the user input control. Based upon receiving multiple signals from the user input control to resume printing, each such signal following an indication from the print media sensor that paper has not been picked, the control logic to cause a change-over to occur from one gear train to another gear train.

9 Claims, 11 Drawing Sheets

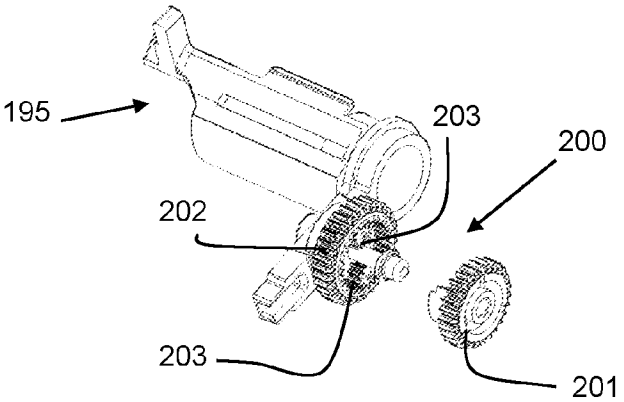
FIG. 7
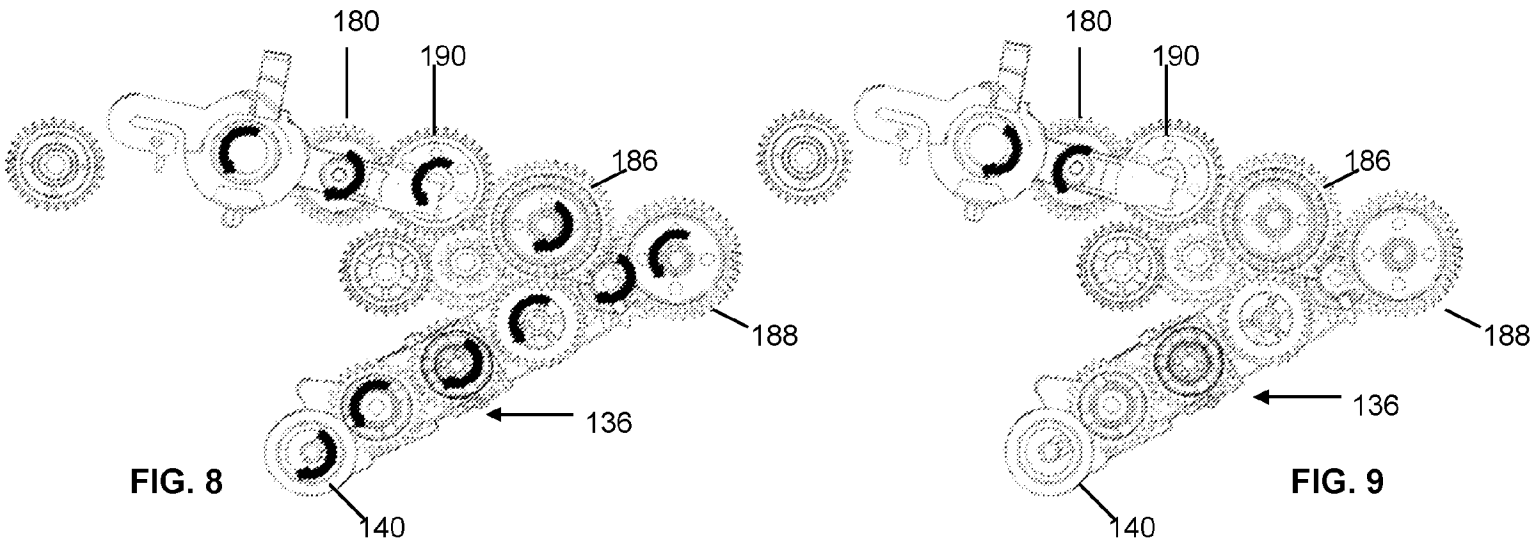
FIG. 8
FIG. 9

CHANGE-OVER BETWEEN GEAR TRAINS IN A PRINTER

BACKGROUND

Printers include a pick mechanism that picks a sheet of paper from a paper tray. The picked sheet of paper is driven through the printer by a series of rollers. If the pick mechanism breaks, the printer may be rendered inoperative.

BRIEF DESCRIPTION OF THE DRAWINGS

For a detailed description of exemplary implementations, reference will now be made to the accompanying drawings in which:

FIGS. 7-9 illustrate the operation of the a gear train that picks one sheet of print media at a time in accordance with an implementation;

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect, direct, optical or wireless electrical connection. Thus, if a first device couples to a second device, that connection may be through a direct electrical connection, through an indirect electrical connection via other devices and connections, through an optical electrical connection, or through a wireless electrical connection.

The term "system" refers to a combination of two or more constituent elements. A system may refer to a combination of multiple stand-alone devices, a single device, or a subsystem within one device. In this disclosure, the term "system" may refer to the entire printer or a portion of the printer.

This document may use the term "paper" but in general, the disclosed printer can print on any suitable type of print media (e.g., fabric, plastic, etc.). Thus, all references to paper should be construed as print media in general.

DETAILED DESCRIPTION

Figure 1:
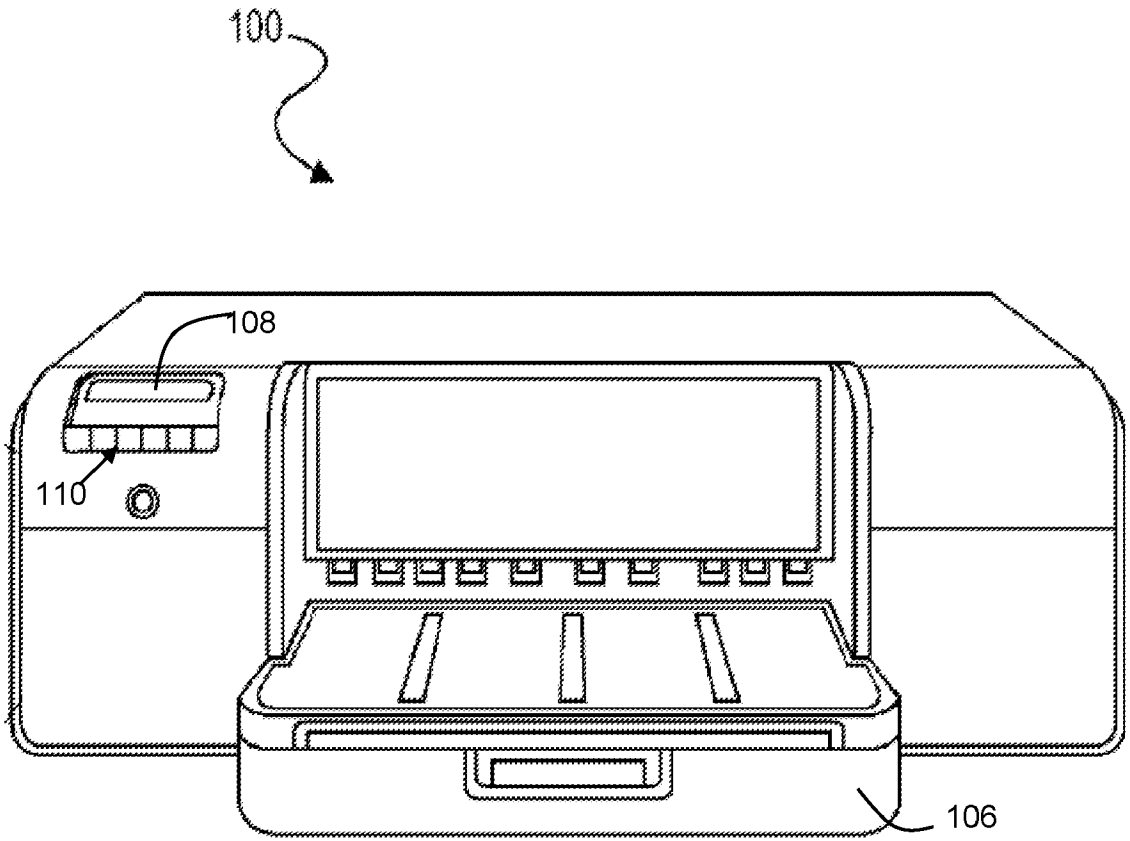
FIG. 1 shows a printer in accordance with an implementation.

FIG. 1 shows a printer 100 in accordance with various implementations. The printer 100 includes a tray 106 in which multiple sheets of print media can be placed. A user display 108 is also included to provide visual feedback and information to the user of the printer. The printer includes one or more user input controls 110 (e.g., buttons) that can be activated by the user to cause various actions to be performed by the printer.

As will be explained below, the printer 100 includes multiple gear trains that drive one or more "pick wheels." In the embodiments described herein, two gear trains are provided, but more than two gear trains are possible in other embodiments as well. A pick wheel (which may also be called a tire) contacts print media (e.g., paper) in the tray 106 and the rotating pick wheel pulls one sheet of print media at a time from the tray into the printer for printing.

Each gear train comprises one or more gears. A motor causes the gears to turn thereby turning the pick wheel(s). One gear train may implement "tail gating" in which the next sheet of print media is picked immediately after the preceding sheet has been picked (with only a short gap between the sheets). The other gear train picks a single sheet at a time (no tail gating). The former gear train is used to print a multi-sheet document while the latter gear train is used to print a single sheet document or is used to print the last page of a multi-sheet document to avoid picking an extra blank sheet following the completion of the document.

If a gear in one of the gear trains is missing or breaks, that gear train may be rendered inoperative. In accordance with various implementations, control logic in the printer determines this condition and causes a default change-over to the other gear train so that the printer can continue to operate. For example, if the gear train that implements tail gating is rendered inoperative, the control logic may cause a change-over to occur to the non-tail gating, single page gear train. From that point on, multi-page documents can still be printed but a much slower pace due to the loss of tail gating. Instead, one sheet of print media will be printed and pushed out of the printer before the next sheet can be picked from the input tray 106.

In various embodiments, the control logic determines that one of the gear trains has become inoperative by monitoring signals from a print media sensor which is located, for example, generally adjacent the printhead. The sensor detects, for example, the leading edge of a sheet of print media just before the print media reaches the printhead. The print media sensor may also be referred to as an "out-of-paper" sensor because its signal may be indicative of the presence or absence of print media in tray 106. Given the known speed at which print media moves through the printer and where the print media currently is located using the sensor signal, the printhead can be properly timed to fire ink onto the moving print media. A repeated indication from the print media sensor signal that no print media is being detected may indicate that the gear train being used is inoperative, as opposed to the tray 106 simply being out of print media; otherwise, a user likely would have observed the failure of the print job to complete and replenished the tray 106. The control logic reacts to this determination by defaulting to another gear train. The new gear train remains selected until, for example, the printer is reset.

Figure 2:
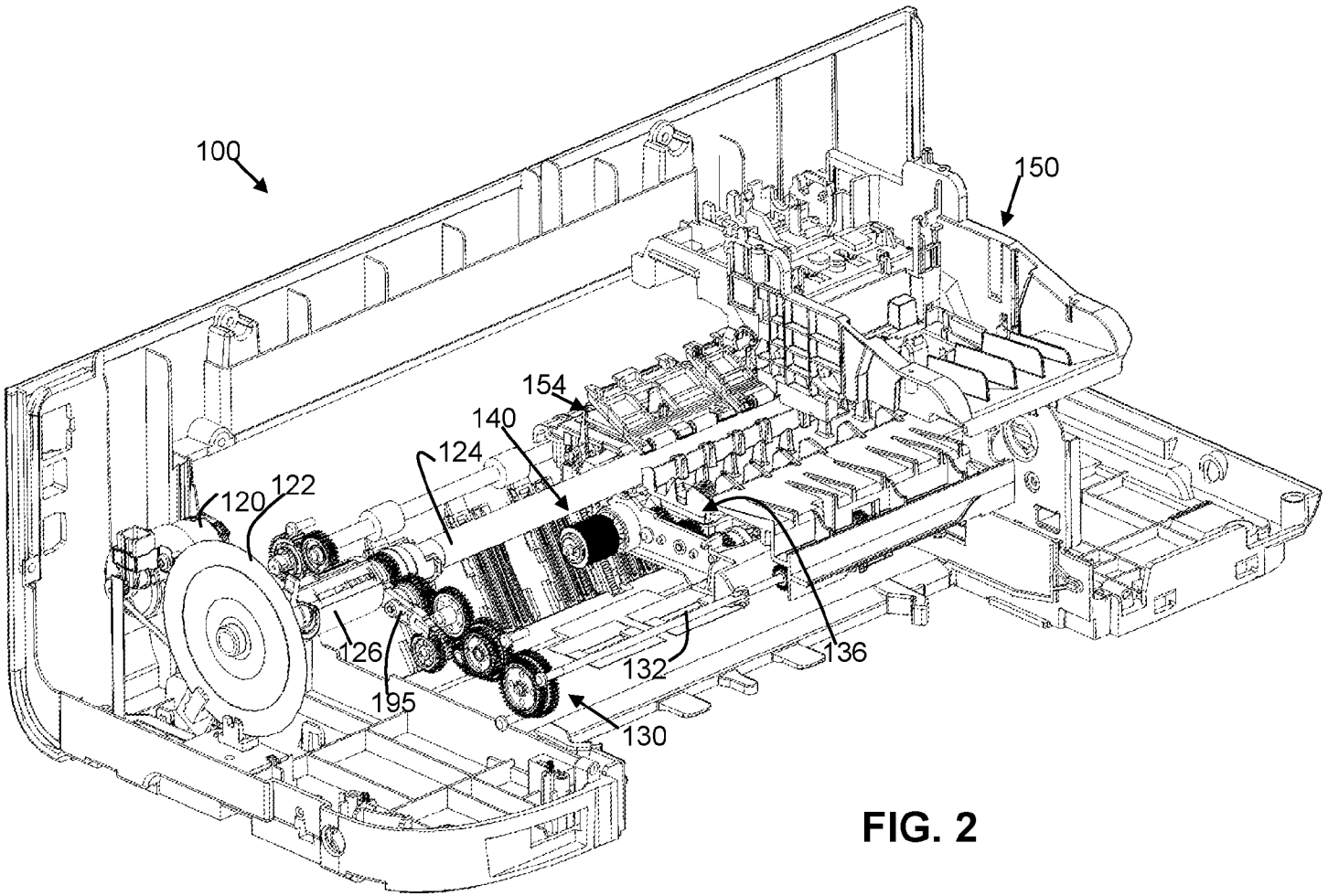
FIG. 2 shows portions of the internal structure of a printer in accordance with an implementation.
Figure 4:
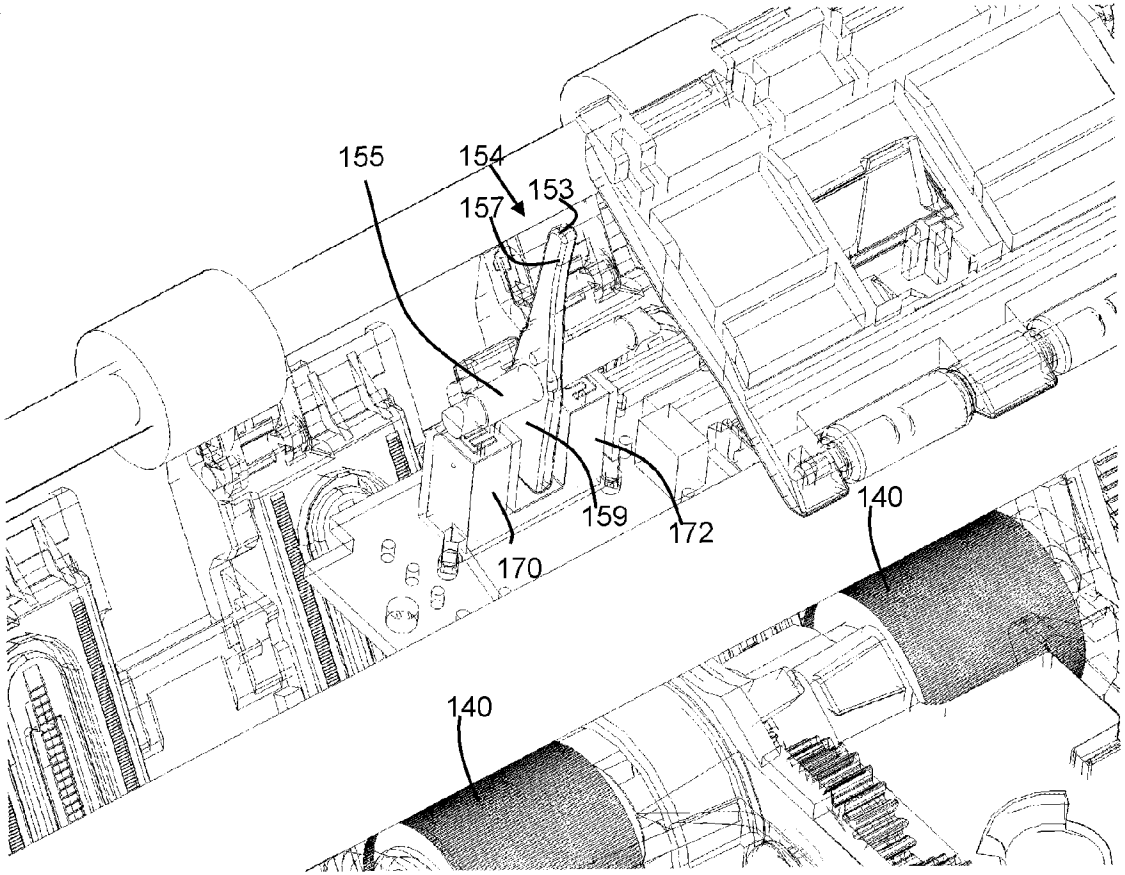
FIG. 4 shows a close-up view of a print media sensor in accordance with an implementation.
Figure 10:
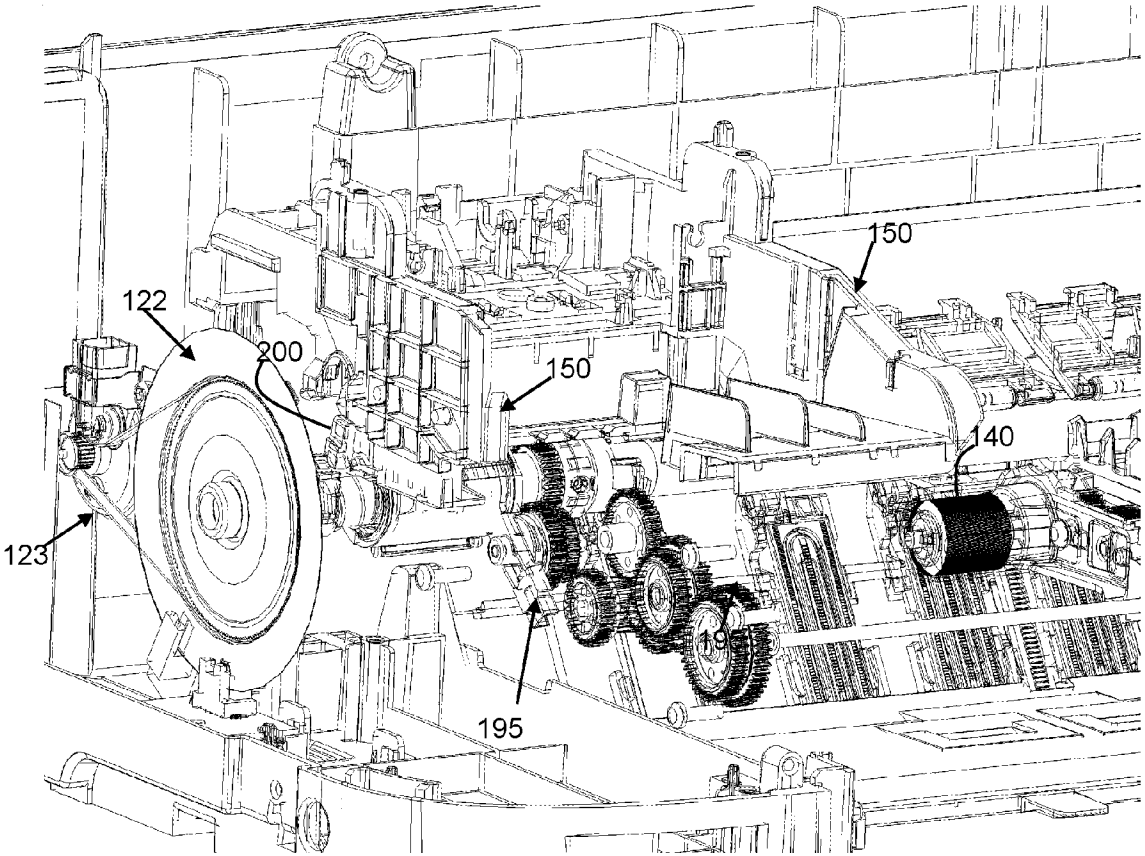
FIG. 10 illustrates a pen carrier contacting a contact tab to cause a change from one gear train to another in accordance with an implementation.

FIG. 2 shows at least some of the internal components of printer 100. As shown, printer 100 comprises a print media motor 120, an encoder disk 122, a feed shaft 124, a gear assembly 130, a pick shaft 132, pick wheel gears 136, and multiple pick wheels 140 (although only a single pick wheel is possible in other implementations). The motor 120 is mechanically coupled to the encoder disk 122 by way of a belt (not shown in FIG. 2 but is shown in FIG. 10—belt 123). The rotation of the encoder disk 122 causes the feed shaft 124 to turn which thereby causes various gears comprising gear assembly 130 to turn. The gear assembly 130 causes the pick shaft 132 to rotate which then causes the gears comprising pick wheel gears 136 to turn. The pick wheels 140 are caused to turn by the rotation of the pick wheel gears 136. One pick wheel 140 is visible in FIG. 2, but multiple pick wheels are included in this embodiment as can be seen in FIG. 4. One or more of the motor 120, encoder disk 122, gear assembly 130, pick shaft 132, gears 136, and pick wheels 140 comprise a "pick system" which is activated by control logic to pick print media from tray 106.

Printer 100 also comprises a pen carriage 150 which is configured to hold one or more ink cartridges (e.g., black, cyan, yellow, etc.). In at least some implementations, each ink cartridge (not specifically shown) contains an ink reservoir and a printhead for ejecting ink drops onto the print media as the print media moves through the printer. The pen carriage 150 moves back and forth in the printer 100 across the width of the print media.

A print media sensor 154 is also shown adjacent the pen carriage 150 (and thus adjacent the printheads) when the pen carriage is at its idle position to the far as shown in FIG. 2. The print media sensor 154 comprises a mechano-optical device in some implementations and will be described and shown with regard to additional figures. The sensor 154 indicates when the leading edge of a sheet of print media reaches the sensor.

Figure 3:
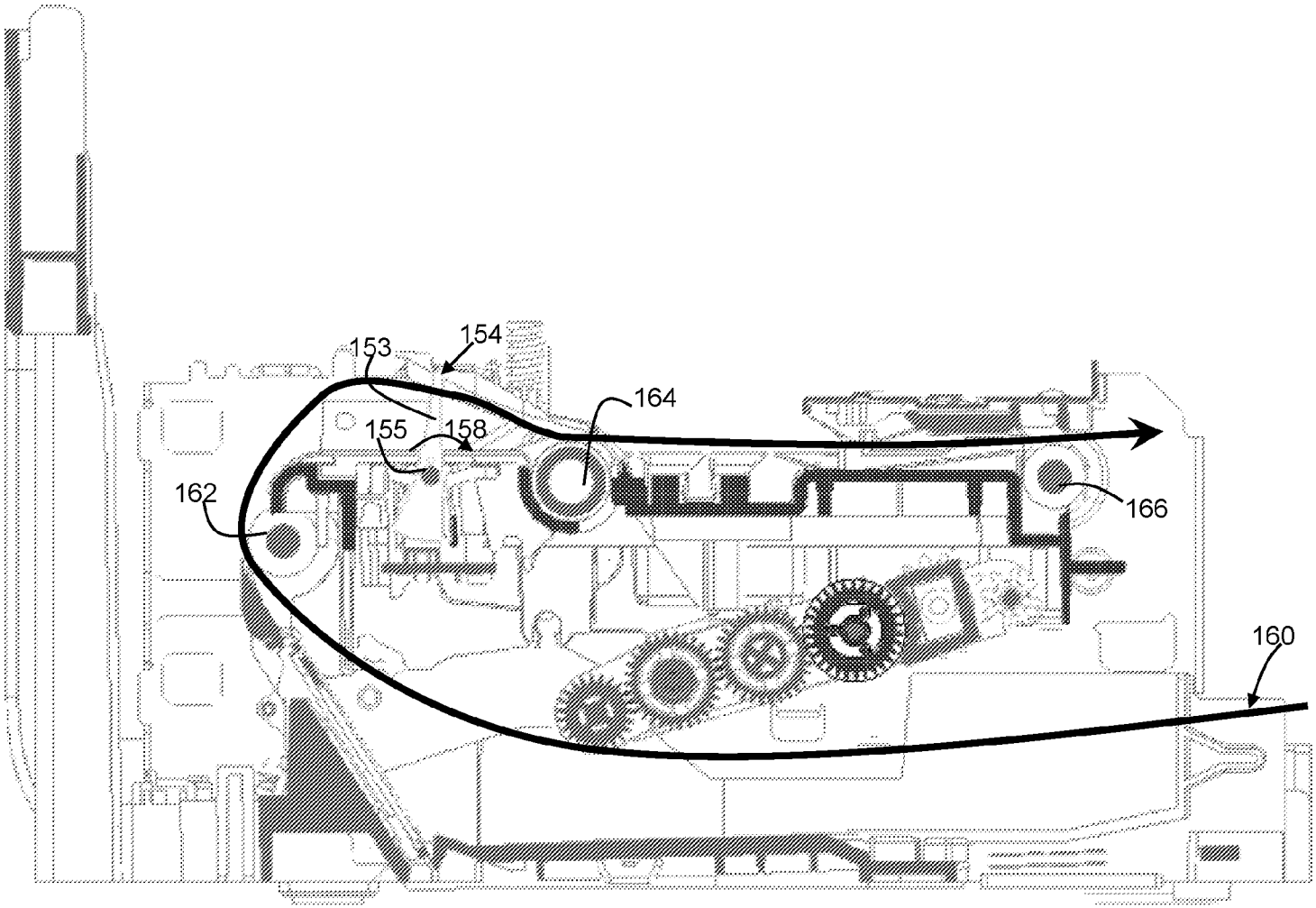
FIG. 3 shows illustrates the paper path through a printer in accordance with an implementation.

FIG. 3 shows a side view of the printer and illustrates the path 160 that the print media takes as it is pulled from the tray 106 by the pick wheels 140 and is routed through the printer. Various rollers 162 and 166 and feed shaft 124 turn thereby causing the print media to be forwarded on along path 160 from the tray 106 and through the area of the printheads. The print media sensor 154 is also shown in FIG. 3. The sensor 154 comprises a mechanical flag 153 that is hinged about a pin 155 and is pushed forward along direction 158 by the force of the leading edge of a sheet of print media.

FIG. 4 shows additional detail of the print media sensor 154. The mechanical flag 153 comprises a head portion 157 above pin 155 and a tail portion 159 below pin 155. The print media's leading edge pushes against the head portion 157 thereby causing it to rotate forward about pin 155. As a result, the tail portion 159 also rotates about pin 155 toward the rear of the printer. The tail portion 159 normally rests between an optical emitter 170 (e.g., a light emitting diode) and an optical detector (e.g., a photo detector) 172. As the print media causes the mechanical flag 153 to rotate, the tail portion 159 rotates out from between the optical emitter and detector 170, 172. The optical detector 172 generates an electrical signal based on whether the light from emitter 170 is blocked by the sensor's tail portion 159. Thus, a signal from the print media sensor 154 indicates whether the print media has passed by the location of the sensor. That information may be used to control the timing of the firing of the printhead nozzles. As will be explained below, the sensor's signal also may be used to determine whether a gear train is inoperative.

Referring again to FIG. 2, gear assembly 130 comprises multiple gears as can be seen. Some of such gears comprise one gear train (designated as a first gear train or "Gear Train 1") and another set of gears comprise a different gear train (designated as a second gear train or "Gear Train 2"). One or more of the gears may be common to both gear trains.

Figure 5:
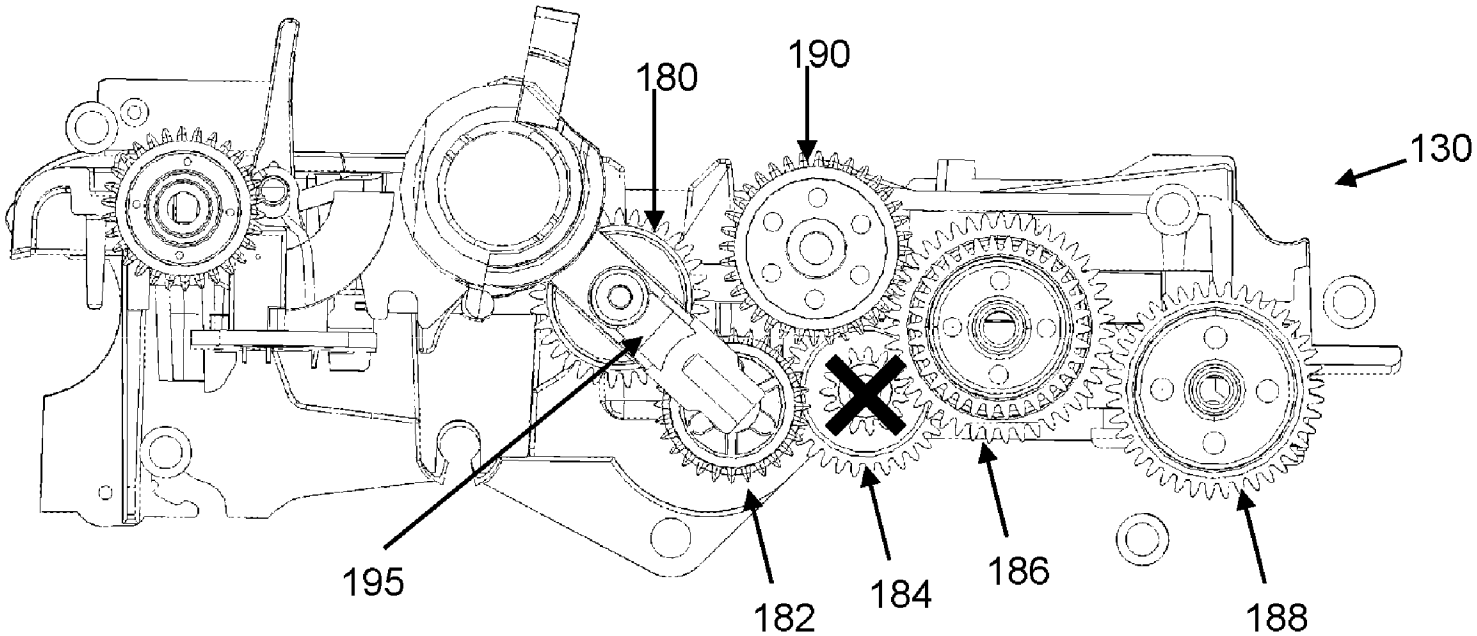
FIGS. 5 and 6 depict engagement to various gear trains in accordance with an implementation.
Figure 6:
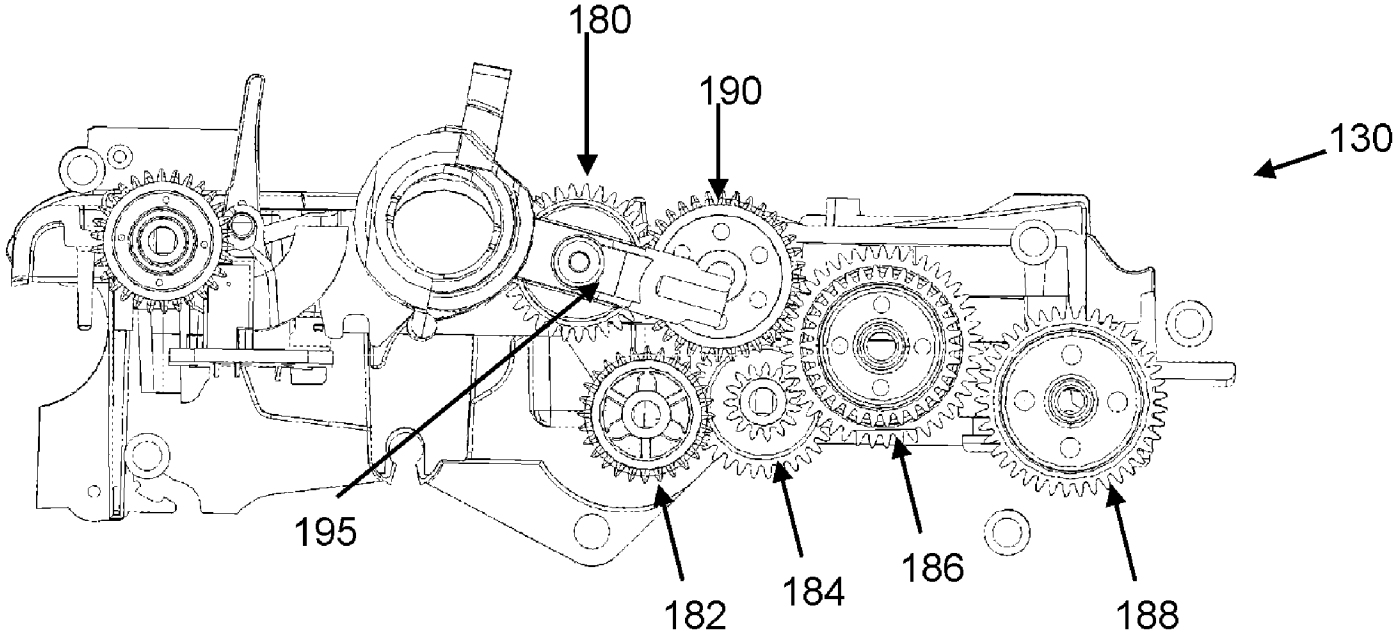

FIGS. 5 and 6 identify each gear train in accordance with various implementations. In the examples shown, gear assembly 130 comprises gears 180, 182, 184, 186, 188, and 190, although a different number of gears is possible in other embodiments. FIG. 5 illustrates the cooperation of at least some of the gears comprising Gear Train 2, and FIG. 6 illustrates the cooperation of at least some of the gears comprising Gear Train 1. Gear Train 2 comprises gears 180, 182, 184, 186, and 188 sequentially enmeshed in the order shown (i.e., gear 180 enmeshed with gear 182 which is enmeshed with gear 184, and so on). The pick wheel gears 136 also form part of Gear Train 2. Gear Train 1 comprises gears 180, 190, 186, and 188 enmeshed in the order shown. The pick wheel gears 136 also form part of Gear Train 1.

As shown in FIG. 7, the selector arm 195 has a single way clutch system 200 that, in at least some implementations, comprises a gear 201 that connects to Gear Train 1 and another gear 202 that connects to Gear Train 2. In the example of FIG. 7, both gears 201 and 202 are connected by two planet gears 203 which will only transmit power via Gear Train 1 to the pick tire when feed shaft 124 is rotating backward (i.e., counterclockwise) as shown in FIG. 8. No power is transmitted to the pick tires 140 when feed shaft 124 is rotating forward (clockwise) as shown in FIG. 9. Thus, a single sheet is picked by having the feed shaft 124 rotate backward. When the paper hits the paper sensor 154, the feed shaft 124 will rotate forward to feed the paper forward for printing. As no power is transmitted to the pick tires when feed shaft is rotating forward, the subsequent page is not picked. In various implementations, Gear Train 2 does not have such a single way clutch system along the gear train and thus will provide a continuous drive power to the pick tires continuously picking pages from the tray 106, thereby creating tail gating between pages.

A problem may occur by which one gear train is not operational. For example, one or both of gears 182 and 184 in Gear Train 2 may be broken (e.g., broken gear tooth) or missing (e.g., failure to install a gear during assembly of the printer). Gear 184 in FIG. 6 is depicted with an "X" to illustrate that that gear may be broken. Whatever the reason for the non-operational status of a gear train, the printer 100 will be unable to print using the defective gear train—print media will not be picked.

In accordance with various embodiments, control logic (illustrated below with regard to FIG. 11) uses the print media sensor 154 to determine when a gear train is non-operational. In response, the control logic causes the printer instead to use the other, operational gear train.

FIGS. 2, 5 and 6 further show a selector arm 195. The selector arm 195 in FIGS. 2 and 5 is in a lowered position to engage Gear Train 2. In FIG. 6, the selector arm 195 is shown in a higher position to engage Gear Train 1.

FIG. 10 also shows the selector arm 195 in the lower position thereby causing engaging Gear Train 2 to be engaged and thus selected. The pen carriage 150 is also shown in FIG. 10 and is just in contact with a contact tab 200. As the pen carriage 150 is further moved by the carriage motor (not shown in this disclosure) to the left toward the encoder disk 122, the pen carriage 150 pushes against the contact tab 200. The contact tab 200 then causes the selector arm 195 to be disengaged from Gear Train 2. The encoder disk 122 then rotates backward by a known amount of encoder counts. This action simultaneously brings the selector arm 195 to the Gear Train 1 position. The pen carriage 150 then moves away from the contact tab 200. As a result, the selector arm 195 engages Gear Train 1.

Figure 11:
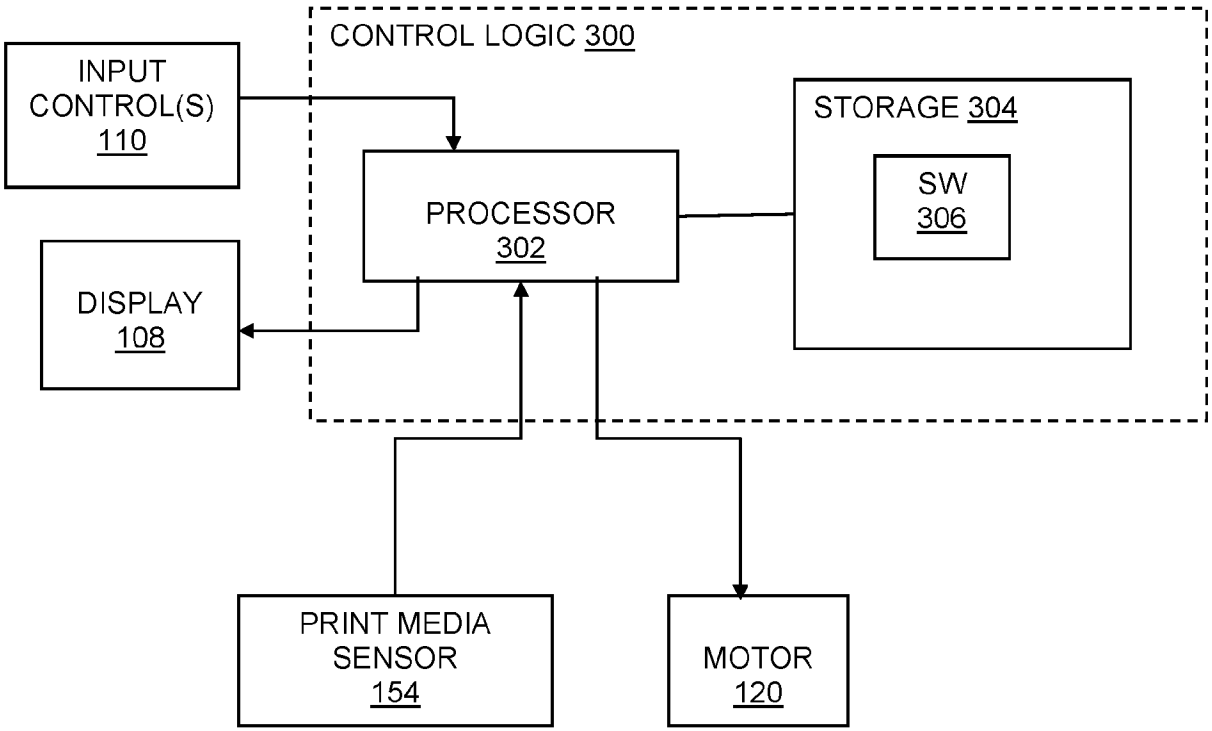
FIG. 11 shows a block diagram of electronics implemented in a printer in accordance with an implementation.

FIG. 11 illustrates an implementation of the control electronics for the printer 100. In the example shown, the printer includes control logic 300, which may comprise a processor 302 coupled to a storage device 304. The storage device 304 may comprise a non-transitory storage device such as random access memory (RAM), read only memory (ROM), a hard disk drive, Flash storage, and the like. The storage 304 contains software 306 that is executable by processor 302 to perform one or more of the actions described herein as attributable to the control logic 300. The control logic 300 receives signals from the print media sensor 154 and provides control signals to operate the motor 120. The display 108 and input control(s) 110 shown in FIG. 1 couple to control logic 300 as well. Each input control may comprise a button in some implementations. Further, one or more of the input controls may be backlit and can be made to blink by the control logic 300. An input control may comprise a "Resume" button that, when pressed, causes the control logic 300 to cause a paused print job to resume printing.

As noted above, the control logic 300 determines when a gear train is non-operational based on the signals from the print media sensor 154. The print media sensor 154 indicates the presence or absence of a sheet of print media at a point along the path 160 (FIG. 3) that the print media would take during printing. When a user of, for example, a computer initiates a print job, a signal is sent to the printer 100 to begin printing. The control logic 300 in the printer activates the pick system (e.g., the motor 120, various gears 130 and 136, pick wheels 140, etc.) to pick the first sheet of print media from tray 106. Given the speed of rotation of the pick wheels 140 and the various rollers 162, 164, and 166 in printer 100, the print media should reach the print media sensor 154 at a known point in time following activation of the pick system.

If the control logic 300 receives a signal from the print media sensor 154 indicative of an absence if print media at the anticipated point in time, the control logic 300 determines that a sheet of print media has not been successfully picked and routed through the printer. The reason for the failure to pick the print media may be uncertain because the tray 106 simply may be empty or the pick system could be broken (e.g., broken or missing gear in the selected gear train). In accordance with various embodiments, the control logic 300 causes an indicator to be visually provided via display 108 to a user that the printer has stopped and that the user should verify whether the tray 106 is empty. The user should check the tray, fill it with print media if necessary and activate an input control 110 to cause the control logic 300 to resume printing. The input control may be a "resume" button. The control logic 300 then will activate the pick system to again attempt to pick a sheet of print media.

If, upon again activating the pick system, the print media sensor 154 again indicates the absence of print media, the control logic 300 again causes feedback to be given to the user (e.g., via display 108) and the user should again check the print media tray 106 if desired and activate the input control 110 to continue printing. Again, the control logic 300 activates the pick system to pick a sheet of print media.

The control logic 300 implements a counter (e.g., via software 306) to count the number of times that the user activates the input control 110 following a detected failure to pick a sheet of print media. Once the user has activated the input control at least a threshold number of times, the control logic 300 determines that the selected gear train is non-operational and activates the pen carriage 150 change the selector arm 195 to the other gear train. For example, if Gear Train 1 is determined to be non-operational, the control logic causes a change-over to Gear Train 2 to occur.

The threshold that indicates a non-operational gear train can be any suitable value. In some implementations, the threshold is 5. In such implementations, the control logic 300 causes a change to the other gear train to occur if the user has activated the input control 110 five times to resume printing on the same attempted sheet of print media. The threshold can be predetermined or configured by a user of the printer 100.

Figure 12:
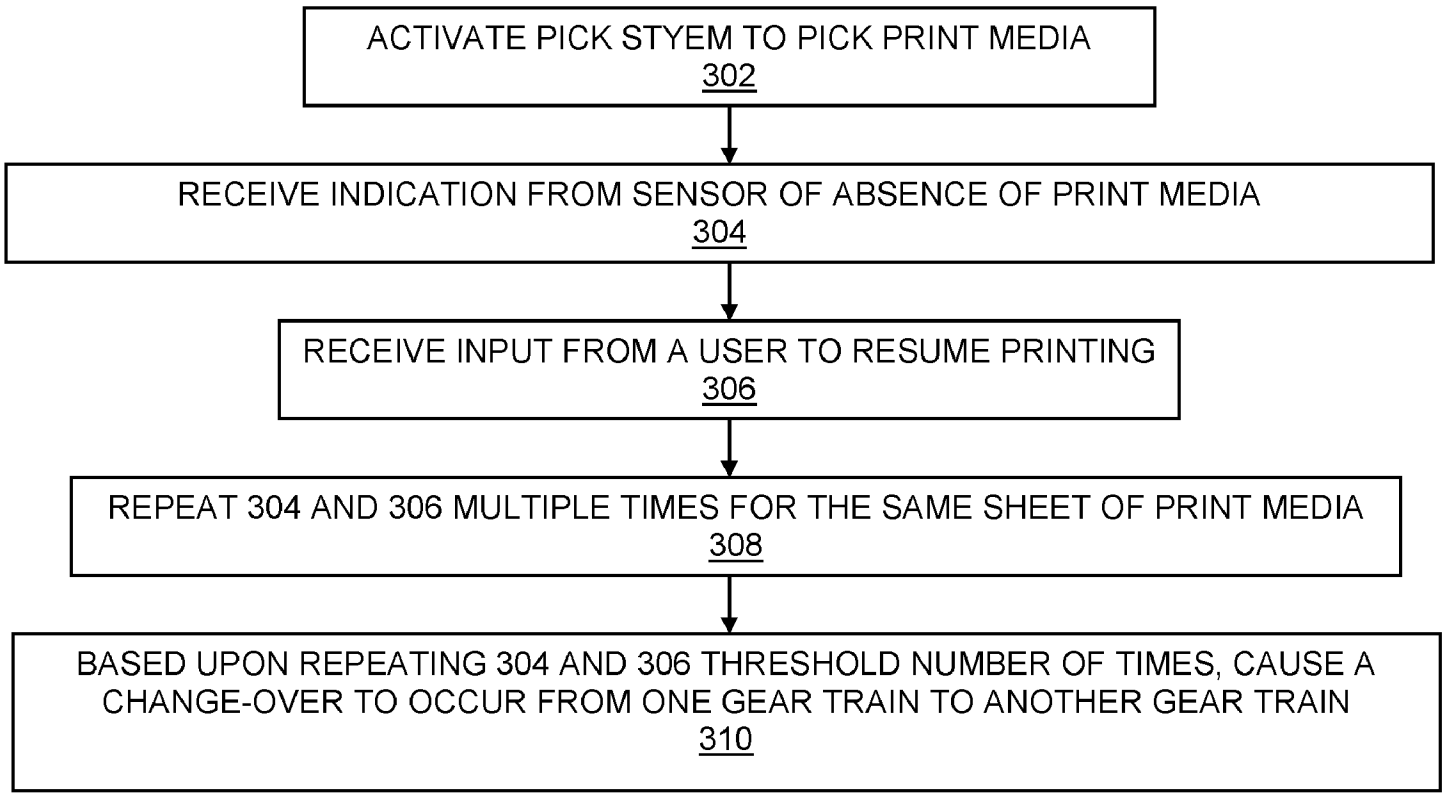
FIG. 12 depicts a method in accordance with an implementation.

FIG. 12 shows a method implementation. The various actions shown can be performed in the order listed or in a different order. Further, two or more of the actions can be performed in parallel. At 302, the control logic activates the pick system to pick a sheet of print media. At 304, the control logic 300 receives an indication from the print media sensor 154 of an absence of print media. This indication may be in the form of an affirmative signal from the sensor 154 or the absence of a signal that otherwise indicates the presence of print media. At this point, the control logic 300 determines that print media was not picked. The method then comprises receiving input from a user to resume printing (306). Actions 304 and 306 are then repeated multiple times for the same sheet of print media (308). Receiving user input to resume printing the same sheet of print media indicates that a gear train has malfunctioned. Consequently, as indicated at 310, the control logic 300 causes a default to the other gear train to occur (e.g., Gear Train 1).

Figure 13:
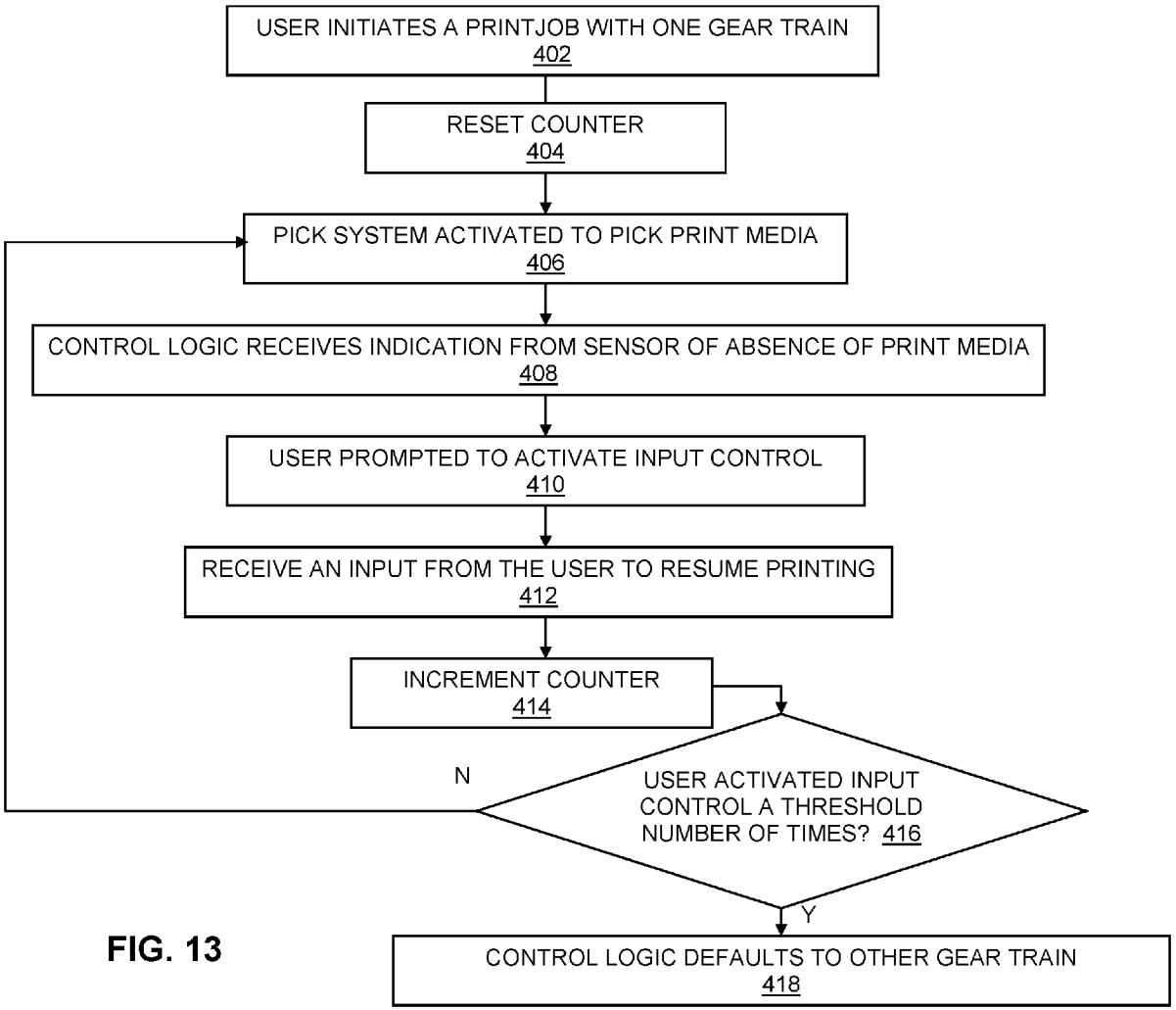
FIG. 13 depicts another method in accordance with an implementation.

FIG. 13 shows another method implementation. The various actions shown can be performed in the order listed or in a different order. Further, two or more of the actions can be performed in parallel. At 402, a user initiates a print job. One of the gear trains is used to start the print job (e.g., Gear Train 2 for a multi-page document). At 404, a counter is reset, and at 406 the control logic activates the pick system to pick a sheet of print media. At 408, the control logic 300 receives an indication from the print media sensor 154 of an absence of print media. This indication may be in the form of an affirmative signal from the sensor 154 or the absence of a signal that otherwise indicates the presence of print media. At this point, the control logic 300 determines that print media was not picked. A user is prompted to activate an input control 110 (action 410). This action may be implemented by causing a backlight on the input control to illuminate (e.g., blink). At 412, the control logic 300 receives an input from the user to resume printing, for example, by detecting the activation of the input control by the user. At 414, the counter is incremented.

At 416, the control logic 300 determines whether the input control has been activated a threshold number of times for the same sheet of print media. In some implementations, this determination is made by comparing the counter to a threshold (e.g., 5). If the threshold has not been reached, control loops back to action 406 in the control logic 300 again activates the pick system to attempt to pick print media. If the threshold has been reached, then at 418, the control logic causes a default to the other gear train to occur (e.g., Gear Train 1).

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A printer, comprising:

a pick system;

a plurality of gear trains, each gear train to pick paper using the pick system;

a print media sensor to detect the presence of print media along a paper path;

a user input control; and control logic coupled to said print media sensor and said user input control;

wherein, based upon receiving multiple signals from said user input control to resume printing each such signal following an indication from said print media sensor that paper has not been picked, said control logic to cause a change-over to occur from one gear train to another gear train.

2. The printer of claim 1 wherein said control logic causes the change-over to occur between gear trains upon receiving a threshold number of signals from the user input control to resume printing.

3. The printer of claim 1 wherein said threshold is 5.

4. The printer of claim 1 wherein said control logic causes the change-over to occur between gear trains upon receiving a threshold number of signals from the user input control to resume printing on a same sheet of print media.

5. The printer of claim 1 wherein said control logic causes the change-over to occur between gear trains upon receiving five signals from the user input control to resume printing on a same sheet of print media.

6. The printer of claim 1 wherein said user input control comprises a resume button.

7. The printer of claim 1 wherein said other gear train remains selected by the control logic until the printer is reset.

8. A method, comprising:

activating a pick system in a printer to pick print media;

receiving an indication from a print media sensor of an absence of print media;

receiving an input from the user to resume printing;

repeating said receiving the indication and receiving the input a plurality of times for a same sheet of print media; and based upon repeating said receiving the indication and receiving the input a threshold number of times, causing a change-over to occur from one gear train to another gear train to pick print media via the pick system.

9. The method of claim 8 wherein the threshold is 5.

* * * * *